United States Patent [19]

Shimazaki et al.

[11] Patent Number: 5,023,666

[45] Date of Patent: Jun. 11, 1991

[54] IMAGE FORMING APPARATUS USING AN IMAGE CARRIER WITH MULTIPLE LAYERS

[75] Inventors: Takashi Shimazaki; Kenichi Tsuneeda, both of Yokohama, Japan

[73] Assignee: Kabushiki Kaisha Toshiba, Kawasaki, Japan

[21] Appl. No.: 529,754

[22] Filed: May 29, 1990

Related U.S. Application Data

[63] Continuation of Ser. No. 124,949, Nov. 24, 1987, abandoned.

[30] Foreign Application Priority Data

Nov. 26, 1986 [JP] Japan ..... 61-281254

[51] Int. Cl.[5] ..... G03G 21/00

[52] U.S. Cl. ..... 355/269; 430/125; 118/652

[58] Field of Search ..... 355/210, 211, 268, 269, 355/270; 118/652; 430/100

[56] References Cited

U.S. PATENT DOCUMENTS

| | | | |
|---|---|---|---|
| 3,640,707 | 2/1972 | Caldwell | 430/125 X |
| 4,302,521 | 11/1981 | Takei et al. | 430/58 X |
| 4,470,693 | 9/1984 | Dolan | 355/15 |
| 4,664,504 | 5/1987 | Oda et al. | 355/15 |

FOREIGN PATENT DOCUMENTS 61-144682 7/1986 Japan .

*Primary Examiner*—Joan H. Pendegrass
*Attorney, Agent, or Firm*—Cushman, Darby & Cushman

[57] ABSTRACT

An image forming apparatus according to the present invention comprises a photosensitive drum which is characterized by a charge generating layer and a charge transport layer. The drum is charged by means of a main charger. At this time, electric charge is produced and held in the charge generating layer. A light-beam bearing image information is applied to the charge generating layer of the drum through the charge transmission layer, by an exposure system. Thereupon, an electrostatic latent image corresponding to the image information is formed on the surface of the drum. The latent image is developed by means of a developing unit using a toner. Thus, a toner image is formed on the drum surface, from which it is transferred to the surface of a paper sheet by a transfer charger. The developing unit also serves to remove, simultaneously with the development of the electrostatic latent image, those toner particles remaining on the drum surface after the transfer by the transfer charger. The image forming apparatus is particularly characterized in that the light beam, applied by the exposure system, is also guided through the charge transport layer of the photosensitive drum to those regions of the charge generating layer shaded by the residual toner particles, thereby preventing white spots from being formed on a solid black image.

14 Claims, 12 Drawing Sheets

RELATIONSHIP BETWEEN AMBIENT CONDITIONS AND RESIDUAL POTENTIAL, OBSERVED WHEN CHARGE-TRANSPORTATION LAYER THICKNESS IS VARIED

IMAGE FORMING APPARATUS USING AN IMAGE CARRIER WITH MULTIPLE LAYERS

This is a continuation of application Ser. No. 07/124,949, filed on Nov. 24, 1987, now abandoned.

BACKGROUND OF THE INVENTION

The present invention relates to an image forming apparatus, such as a laser printer, and which is adapted to form an image using a reusable image carrier.

As shown in FIG. 1, an image forming apparatus, e.g., a laser printer, comprises a photosensitive drum 2 which is rotated in a predetermined direction. Drum 2 is surrounded by main charger 4, exposure section 8 of exposure system 6, developing unit 10, transfer charger 12, separation charger 14, cleaner 16, and de-electrifier 18, which are arranged successively in the rotating direction of drum 2.

First, the surface of photosensitive drum 2 is charged uniformly by main charger 4, and is then exposed by exposure system 6. Thus, an electrostatic latent image is formed on the drum surface. Subsequently, a toner is supplied to the latent image by developing unit 10. As a result, the latent image is visualized or developed into a toner image. Then, the toner image is transferred, by transfer charger 12, to the surface of a paper sheet which is intimately in contact with the surface of drum 2. Thereafter, the sheet is separated from drum 2 by separation charger 14.

Those toner particles remaining on the surface of photosensitive drum 2, without having been transferred to the sheet surface, are removed by means of cleaner 16. Thereafter, the electrostatic latent image on the surface of drum 2 is erased. Thus, one cycle of image formation is finished.

Conventionally, the residual toner particles on the surface of photosensitive drum 2 are scraped off from the drum surface by means of blade 20 attached to cleaner 16. The scraped toner is collected in cleaner 16. Usually, the internal space of cleaner 16 is filled up with the toner after the image is formed on 2,000 to 3,000 sheets. As a result, cleaner 16 becomes unusable.

Image forming apparatuses with the above described construction include ones which are designed so that the disabled cleaner can be discarded together with photosensitive drum 2. In these apparatuses, however, the expendables cost much. In the case of frequently used apparatuses, such as printers, in particular, they will become unusable during the replacement of cleaner 16 and drum 2. Therefore, such apparatuses are not preferred.

In prior art image forming apparatuses, toner conveyor screw 22 for toner recovery is provided within cleaner 16. Screw 22 serves to deliver the toner in cleaner 16 to a toner recovery box (not shown) outside the cleaner. Thus, the toner is recovered.

The recovery box is bound to occupy a certain space inside the apparatus, so that it cannot be large in size. Also, after an image is formed on several thousands of paper sheets, the box must be replaced with a new one. At the time of removal of the box, some of the toner may possibly spill, thereby soiling the operator's hands or clothes, or the floor.

Blade 20 of cleaner 16 is brought into contact with the surface of photosensitive drum 2 so that the drum surface is liable to be scratched thereby. For example, an OPC (organic photoconductor) photosensitive drum is safe and harmless. Due to its softness, however, the drum of such a material can enjoy only a very short life. If photosensitive drum 2 has a short diameter, in particular, it must rotate many times to accomplish recording on each paper sheet. Accordingly, one and the same portion of drum 2 would be used very frequently for each sheet so that the life and the replacement cycles of the drum are inevitably short. It is not advisable, therefore, to use a slender photosensitive drum. Thus, the apparatus cannot be easily reduced in size.

In order to settle these problems, image forming apparatuses without a cleaner have been developed (U.S. patient application Ser. Nos. 571,800 and 901,312; U.S. Pat. Nos. 3,117,884; 3,649,262; 3,997,262; 4,320,958; 4,384,545; 4,426,151; and 4,470,693; and German Patent Publication Nos. 3,006,033 and 3,140,190). In these apparatuses, the developing unit has a cleaning function, that is, development and cleaning are effected simultaneously by means of the developing unit.

In the image forming apparatuses of this type, however, a photosensitive drum is charged by means of a main charger from above those toner particles which remain on the surface of the drum to be transferred therefrom to the surface of a paper sheet by means of a transfer charger. Although some regions of the drum surface are charged, therefore, other regions are not. Thus, the surface potential of the drum is subject to unevenness.

SUMMARY OF THE INVENTION

The object of the present invention is to provide an image forming apparatus permitting reduction in size and weight without requiring use of a toner recovery box, obviating the possibility of soiling, and allowing the image carrier to enjoy a longer life.

According to an aspect of the present invention, the image forming apparatus includes an image carrier with a charge generating layer for holding a charge and a charge transport layer covering the charge generating layer. The charge transport layer is of a type which passes charge therethrough.

A charging means charges the image carrier so that an electric charge is produced and held in the charge generating layer. An exposure means applies a light beam, bearing image information, to the charge generating layer through the charge transport layer and thereby forms an electrostatic latent image corresponding to the image information on a surface of the image carrier. The electrostatic latent image is developed by a developing agent and forms a developed image on the surface of the image carrier. The developing means removes, simultaneously with the developing of the electrostatic latent image, the residual developing agent remaining on the surface. The charge generating layer must have a sufficient thickness such that the light beam applied by the exposure means can pass through the charge transport layer and impinge on those layers of the charge generating layer which are shaded by the residual developing agent. According to another aspect of the invention, a method is provided for forming an image using toner particles which uses similar steps.

According to this arrangement, the developing agent remaining on the surface of the image carrier is removed simultaneously with the development by electrical attraction using the developing means. Therefore, the apparatus can be reduced in size and weight without requiring use of a toner recovery box, cannot soil anything, and allows the image carrier to enjoy a longer life. The image carrier is composed of the charge generating layer and the charge transport layer covering the same. If the image carrier, with the developing agent remaining thereon, is exposed, therefore, a satisfactory image can be obtained without any shadows of the developing agent on the charge generating layer.

DETAILED DESCRIPTION OF THE PREFERRED EMBODIMENTS

Figure 1:
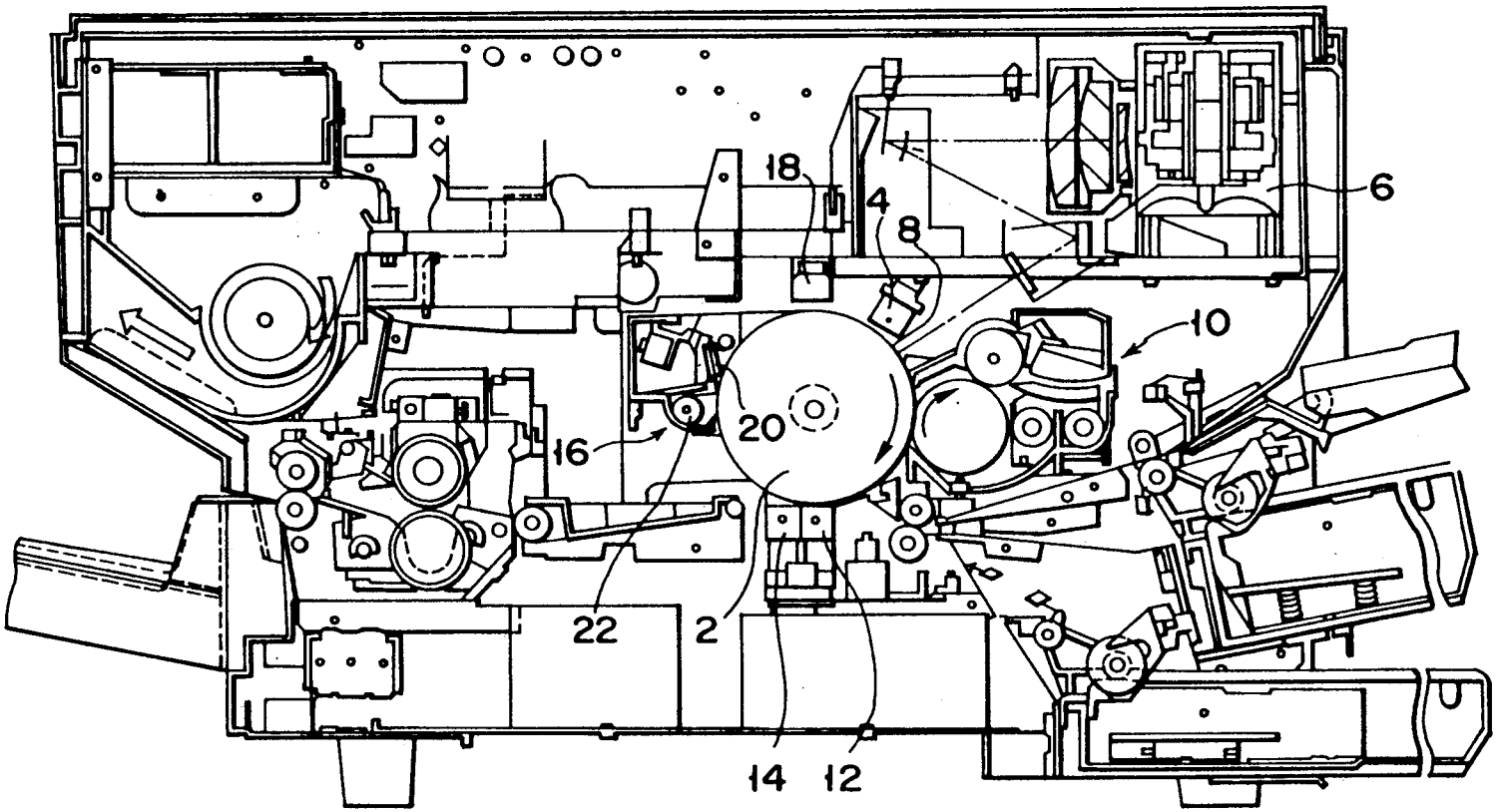
FIG. 1 (PRIOR ART)
FIG. 1 is a sectional view schematically showing a prior art image forming apparatus.
Figure 2:
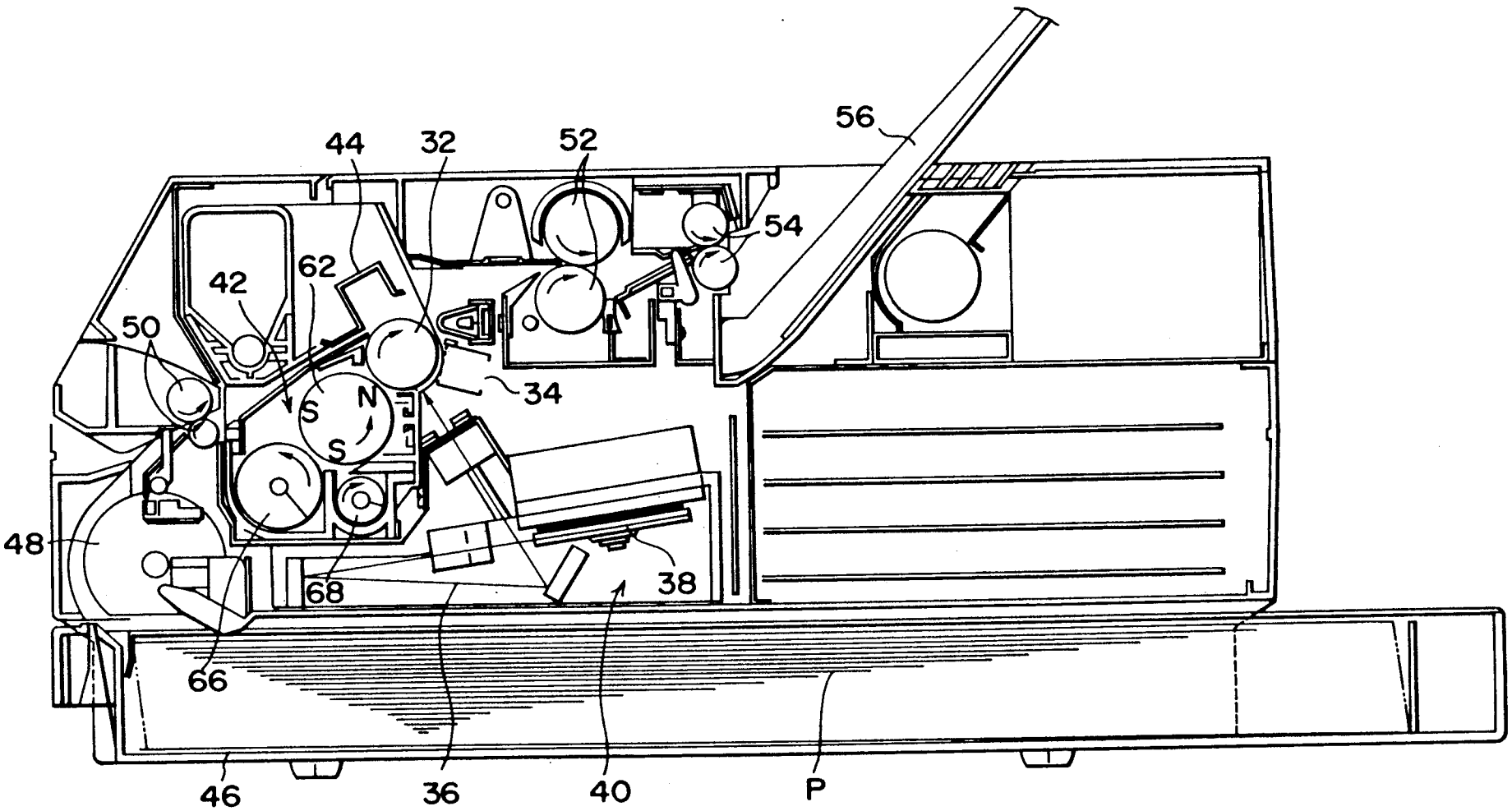
FIG. 2 is a sectional view schematically showing an image forming apparatus according to the present invention.

FIG. 2 shows a laser-beam printer as an image forming apparatus according to the present invention. This printer is an image forming apparatus of an electrophotographic recording apparatus using a semiconductor laser.

The printer is connected to a host system (not shown), e.g., a word processor as an external apparatus, by means of a transmission control (not shown), such as an interface circuit. Print signals are supplied from the host system to the printer. In response to these print signals, the printer forms an image.

When a print start signal is applied from the host system to the printer, photosensitive drum 32 is rotated. First, the surface of drum 32 is charged electrically by a charging means which is embodied as main charger 34. When dot image data is then supplied from the host system to the printer, laser beam 36, modulated in accordance with the data, is emitted from optical system 40 including polygon scanner 38 and is guided to the drum surface. The charged drum is exposed to and scanned with laser beam 36. Thereupon, an electrostatic latent image is formed on the surface of drum 32. Then, a toner is applied to the latent image by means of developing device 42. As a result, the latent image is visualized or developed into a toner image. The toner image is transferred to the surface of paper sheet p by transfer charger 44 at a transfer section. Sheet p is fed from sheet cassette 46 to the transfer section by means of paper-supply roller 48 and a pair of aligning rollers 50. After the transfer, sheet p, with the toner image thereon, is delivered to a pair of fixing rollers 52. The toner image is fixed on the surface of sheet p by means of rollers 52. Then, sheet p is discharged onto tray 56 by a pair of exit rollers 54.

Figure 3:
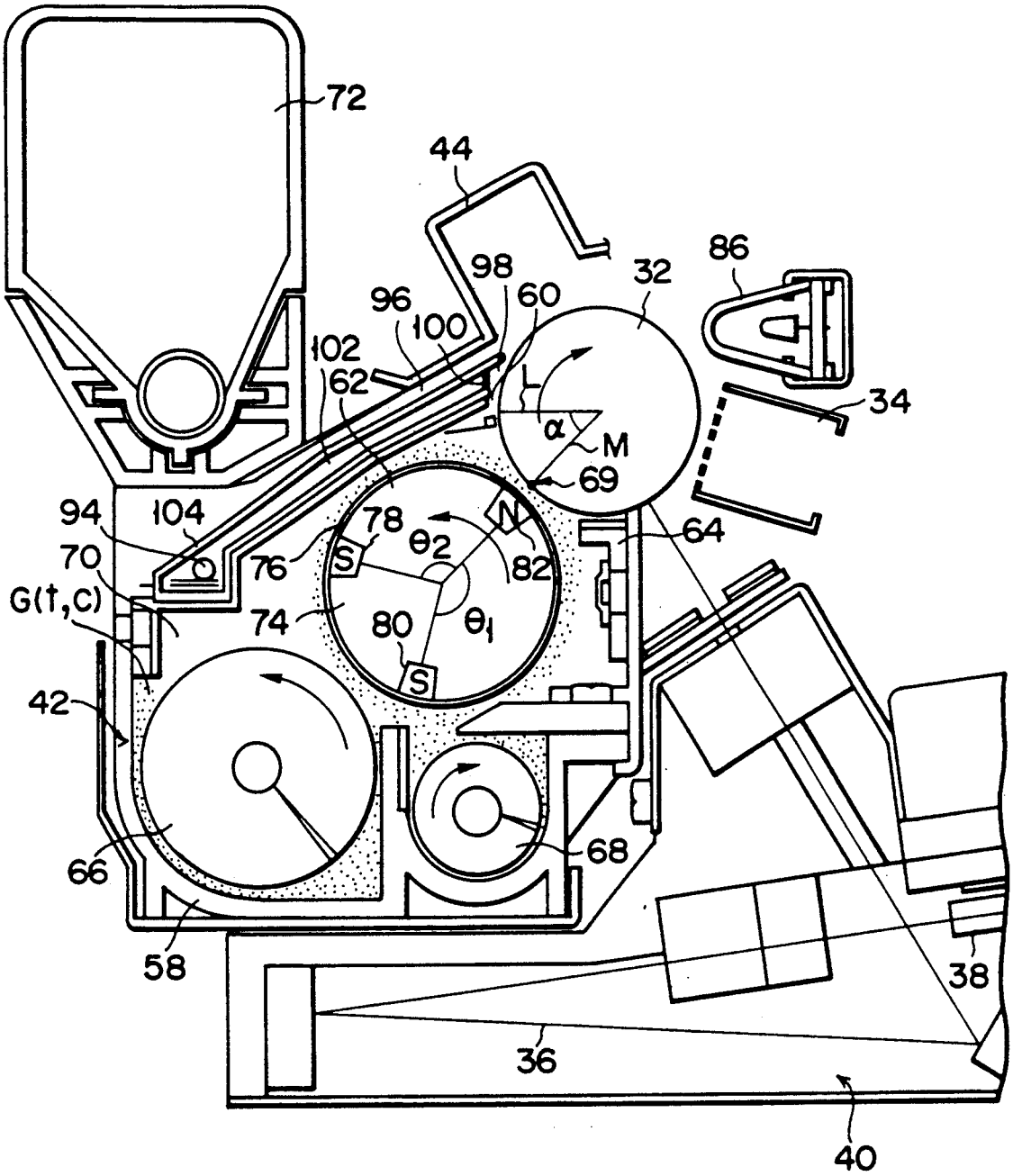
FIG. 3 is a sectional view schematically showing the developing device and peripheral equipment associated therewith.

As shown in FIG. 3, developing device 42 includes casing 58 which has opening 60. Photosensitive drum 32 is located in opening 60. Casing 58 contains therein developing roller 62, doctor 64, developer stirrer 66, and stirring conveyor 68.

Doctor 64 is located in the region where photosensitive drum 32 is in sliding contact with a magnetic brush of a developing agent on developing roller 62, that is, on the upper-course side of developing position 69 with respect to the rotating direction of roller 62. Doctor 64 serves to restrict the thickness of the magnetic brush. Developer stirrer 66 is contained in developer storage portion 70 inside casing 58. Stirring conveyor 66 stirs and conveys replenishing toner t from toner supply portion 72 to storage portion 70. Storage portion 70 stores developing agent G which is composed of toner (color powder) t and carrier (magnetic powder) c.

Developing roller 62 includes magnetic roller 74 and sleeve 76. The center of rotation of roller 74 is situated on line M passing through the center of rotation of photosensitive drum 32 and inclining at angle $\alpha$ (about 50° ) to horizontal line L. Sleeve 76, which is fitted on roller 74, is rotated in the counterclockwise direction of FIG. 3.

Magnetic roller 74 includes three pole blocks 78, 80 and 82. Blocks 78 and 80 are south poles, while block 82 is a north pole. Angle 8 1 between blocks 80 and 82, around the center of developing roller 62, is set to 150° , and angle $\theta_2$ between blocks 82 and 78, around the center of roller 62, is set to 120° .

A reverse development process is executed in developing device 42 described above. After the transfer of the toner image, residual toner t on photosensitive drum 32 is removed simultaneously with the development of the electrostatic latent image. Thus, the electrophotographic process is simplified. FIGS. 4A to 4E and 5A to 5E show the state of toner particles t on drum 32 and changes of the surface potential of drum 32 during the process.

Figure 5A:
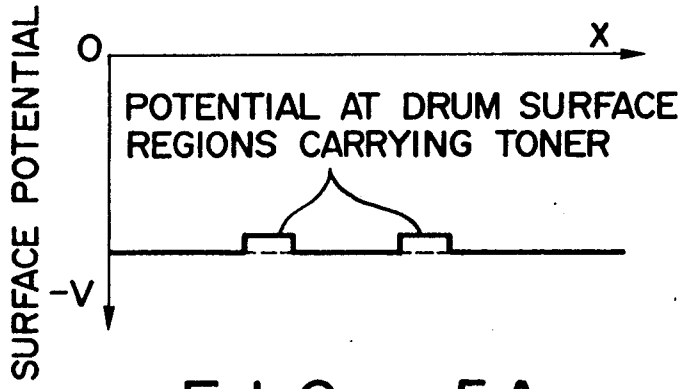
FIGS. 5A to 5E show transitions of the surface potential of a photosensitive drum during the processes of image formation by the apparatus of FIG. 2.
Figure 4A:
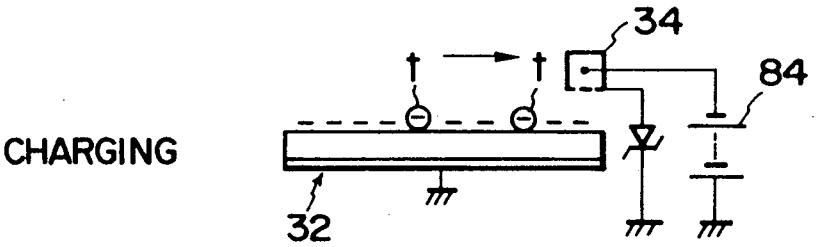
FIGS. 4A to 4E are diagrams for illustrating processes of image formation by the apparatus shown in FIG. 2.

As shown in FIGS. 4A and 5A, photosensitive drum 32 is charged to a level of e.g. −600 V as main charger 34 is supplied with voltage from power source 84. At the same time, toner particles t remaining on drum 32, without having been transferred from drum 32 to sheet p by the previous copying operation, are charged. At the same time, moreover, those portions of drum 32 having residual toner particles t thereon are also charged. The reason for this situation has been made clear by an experiment. In this experiment, when toner t was removed by means of a blade, such as a polyurethane blade, the surface potential of the portions of drum 32 having had the residual toner particles thereon was kept at 80 to 90% of that of those drum portions without any residual toner particles.

In the apparatus according to this embodiment, the surface potential of photosensitive drum 32 is made uniform by using a scoretron charger as main charger 34. As mentioned before, therefore, the surface potential of the portions of drum 32 having had the residual toner particles thereon is only a little lower than that of the portions without the residual toner particles. Practically, such a potential difference is negligible.

Figure 5B:
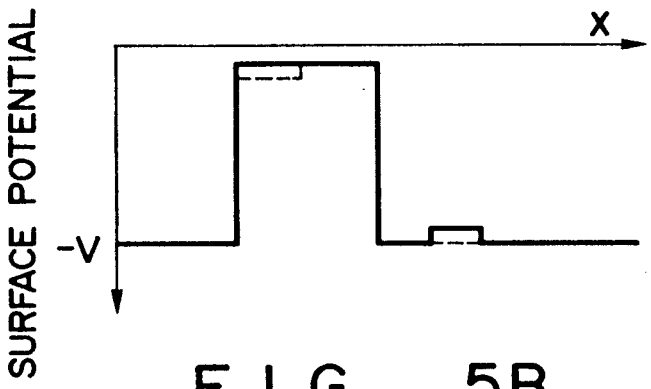
Figure 4B:
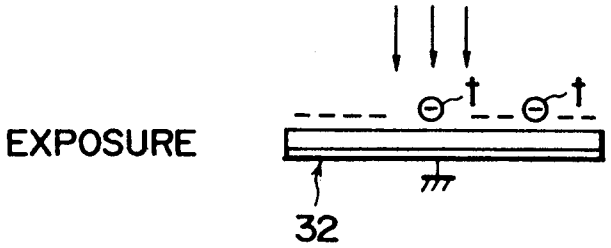

As described above, the surface of photosensitive drum 32 is exposed to laser beam 36 which is modulated on the basis of the dot image data from the host system. By doing this, the surface potential of drum 32 is attenuated. Consequently, the electrostatic latent image is formed on the drum, as shown in FIGS. 4B and 5B.

Figure 5C:
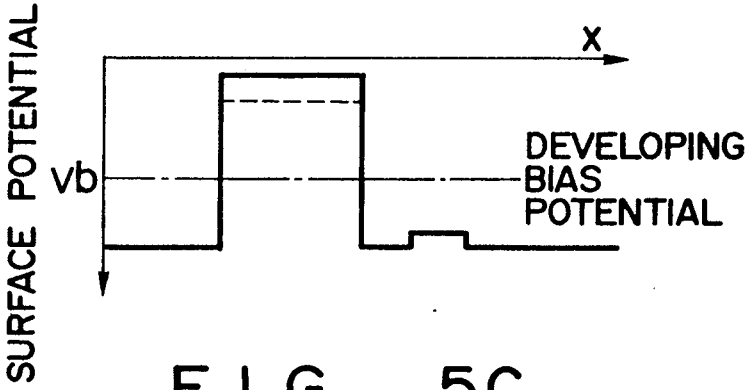
Figure 4C:
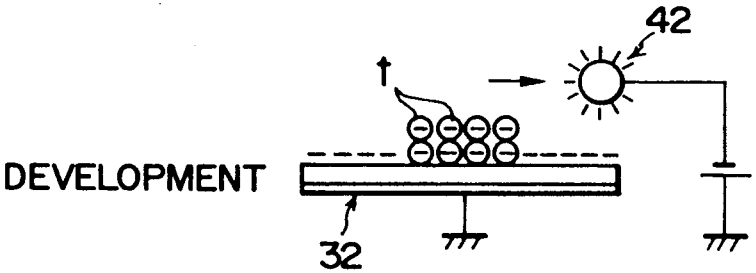

The electrostatic latent image is developed by means of developing device 42. More specifically, device 42 as shown in FIGS. 4C and 5C supplies toner (color powder) t to the latent image, thereby visualizing it into the toner image. At the same time, residual toner particles t, which are not necessary for the formation of the toner image, are removed by means of the developing device.

Figure 5D:
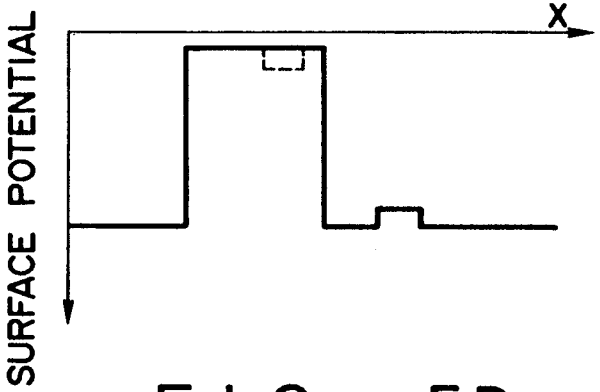
Figure 4D:
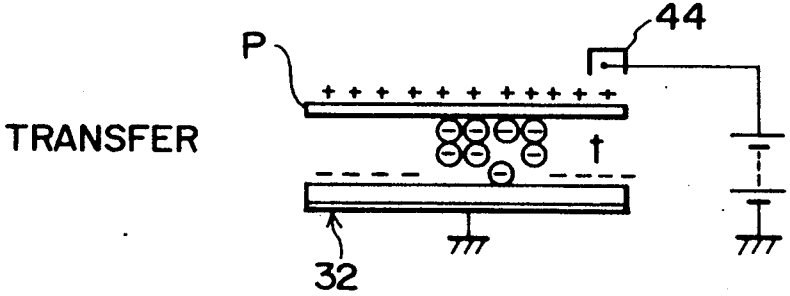

As shown in FIG. 4D and 5D, the toner image is transferred to the surface of sheet p by means of transfer charger 44. Namely, a high voltage opposite in polarity to the negatively charged toner is applied by charger 44. As a result, the reverse side of sheet p is subjected to positive corona discharge, so that the sheet is charged positively. Thereupon, the negative toner image on photosensitive drum 32 is attracted to sheet p.

Figure 5E:
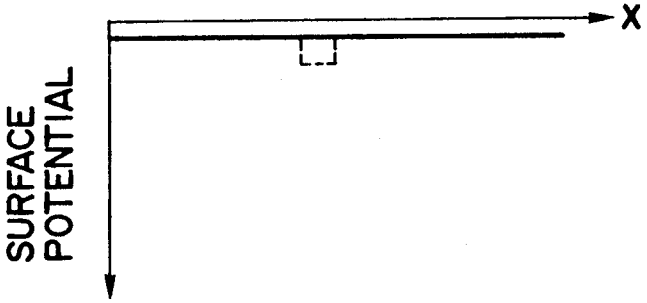
Figure 4E:
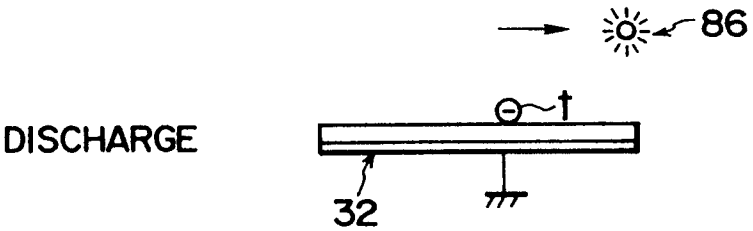

After the toner image is transferred from photosensitive drum 32 to the surface of sheet p, the drum is discharged by de-electrifier 86, as shown in FIGS. 4E and 5E.

The principle, conditions, experimental data, etc., of the present invention will now be described.

It is essential to execute the aforementioned process for simultaneous development and cleaning (hereinafter referred to as cleaning-synchronized development process) by the so-called reverse development method. The reason is that toner t and photosensitive drum 32 are charged to the same polarity, so that the polarity of residual toner t can never be inverted by the charging operation of main charger 34.

Figure 6:
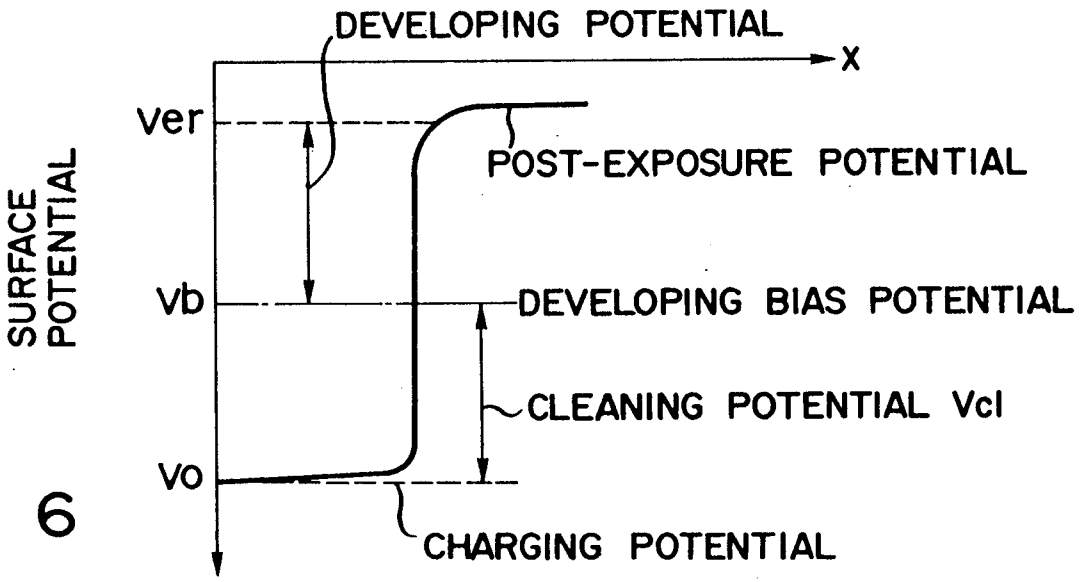
FIG. 6 is a diagram showing the surface potential of the drum obtained during the processes of image formation by the apparatus of FIG. 2.

In order to obtain satisfactory image quality, however, the cleaning-synchronized development process requires specific conditions. FIG. 6 illustrates what the terms used herein mean. Charging potential Vo is the surface potential obtained when the surface of photosensitive drum 32 reaches the developing position unexposed after being charged by main charger 34. Post-exposure potential Ver is the attenuated surface potential obtained when the drum surface is exposed by optical system 40. Developing bias potential Vb is the potential applied to developing roller 62 of developing device 42. Cleaning potential Vcl is the difference (Vo −Vb) between charging potential Vo and developing bias potential Vb. In this embodiment, drum 32 is an OPC (organic photoconductor) photosensitive drum which is suited for negative charging. In consideration of use of a photosensitive drum suited for positive charging, however, Vo, Vb, Ver, Vb−Ver, and Vo−Vb are given as absolute values.

Figure 7:
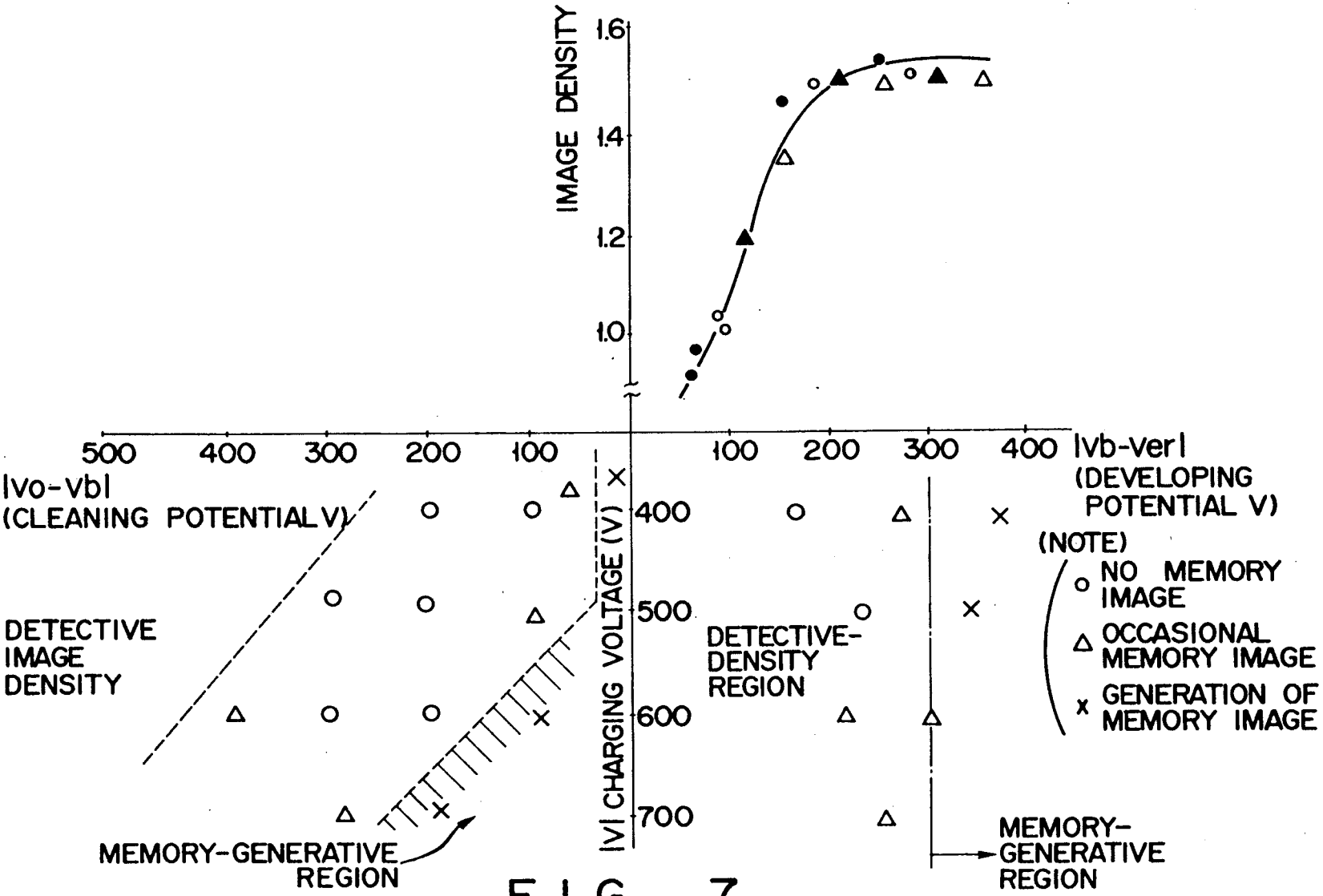
FIG. 7 is a diagram showing the relationships between the surface potential and the image characteristics of the photosensitive drum of the apparatus of FIG. 2.

Measurement data indicative of the relationships between developing potential |Vb−Ver| and the image density are plotted in the first quadrant of two-dimensional coordinates shown in FIG. 7. As seen from FIG. 7, a developing potential of 100 V or more is needed to obtain a satisfactory image density of 1.0 or more.

In the fourth quadrant, moreover, measurement data indicative of the relationships between developing potential |Vb−Ver| and charging potential |Vo| are plotted. Each plot indicates an occurrence of a phenomenon (hereinafter referred to as memory) such that the image formed by the process corresponding to the preceding revolution of photosensitive drum 32 appears in the present image on sheet p, due to defective cleaning. It is indicated that a memory attributable to defective cleaning is produced if the developing potential is higher than 300 V. Presumably, the reason is that if the developing potential exceeds 300 V, the image density never increases, whereas the actual amount of toner adhering to the drum increases, thus entailing an increase of residual toner t.

In the third quadrant, furthermore, there are shown the relationships between cleaning potential |Vo−Vb| and charging potential |Vo|, that is the occurrence of memories on sheet p. When cleaning potential |Vo−Vb| is zero, a memory is bound to be produced. Thus, it may be understood that potential |Vo−Vb| must be 50 V or more.

If cleaning potential |Vo−Vb| becomes too high, however, charge is transferred inversely from developing roller 62 to toner t. As a result, toner t never fails to be charged for the opposite polarity. Thus, if potential |Vo−Vb| becomes 600 V or more, the image will suffer fogging.

A carrier with the maximum magnetic force of 50 to 150 emu/g was used as carrier c in developing agent G, and development was performed with main pole 80 of developing roller 62 adjusted to a magnetic flux density of 1,000 gausses. Thereupon, carrier c adhered to photosensitive drum 32 when cleaning potential |Vo−Vb| is 600 V or more. Thus, it may be understood that potential |Vo−Vb| should preferably be 500 V or less.

In the cleaning-synchronized development process, the properties of the toner are influenced. The following experiment was conducted to examine the toner properties.

First, a photosensitive drum 32 without toner t thereon was charged and exposed, whereby an electrostatic latent image was formed on the drum surface. The latent image was developed into a toner image by the so-called reverse development. The toner image on photosensitive drum 32, at that time, was transferred to a mending tape (from 3 MCo., Ltd.), the tape was stuck to white paper, and the image density was measured by utilizing reflected light. This density is to be designated as Dd.

Then, another toner image was formed on the surface of photosensitive drum 32 in a like manner. This toner image was left on drum 32 without being transferred to sheet p. In this state, a light beam was applied to drum 32 to de-electrify its surface, and the drum surface was then charged again. Then, the toner image, after having passed developing device 42, was transferred to the mending tape without having been exposed or developed, and the image density was measured on white paper. If this density is Dcl, cleaning efficiency can be expressed as follows:

$$\xi = 1 - Dcl/Dd.$$

Figure 8:
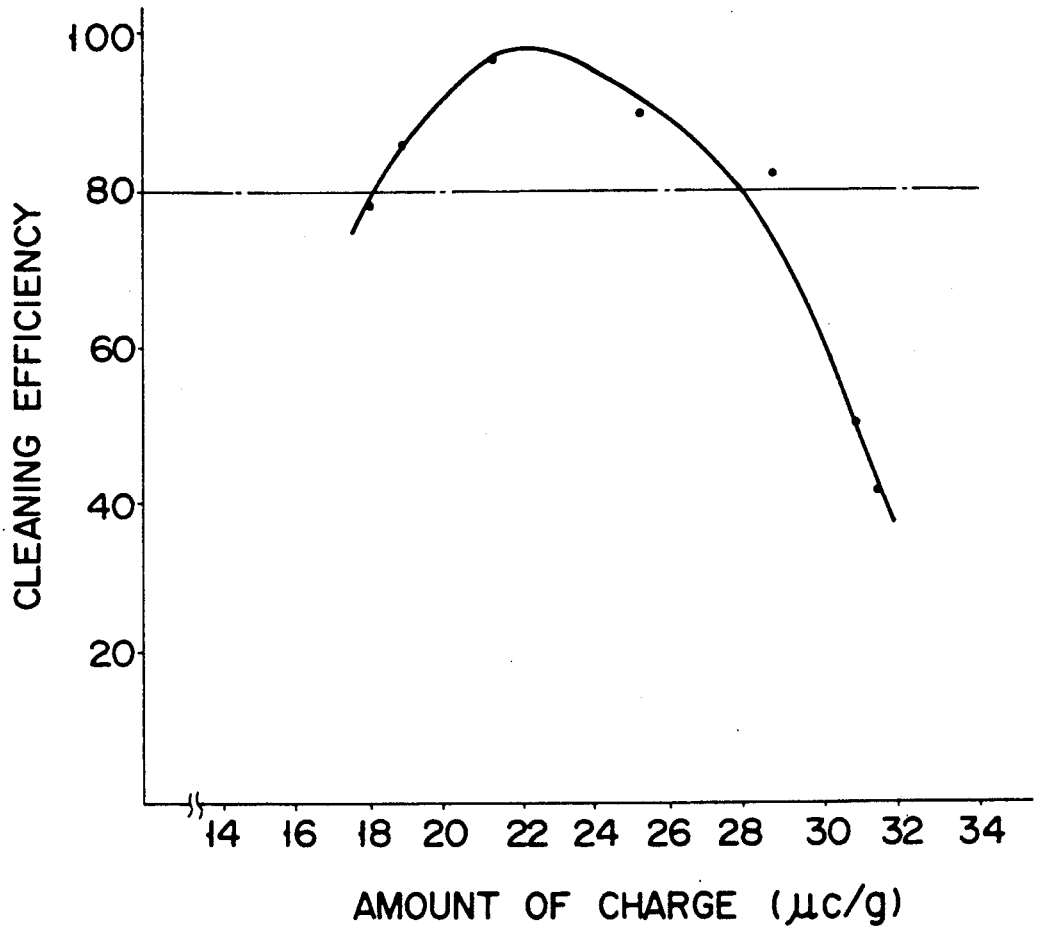
FIG. 8 is a diagram showing the relationships between the amount of charge of toner and the cleaning efficiency of the apparatus of FIG. 2.

Then the cleaning efficiency was examined in such a manner that the amount of charge (μc/g) of toner t in developing device 42, based on the blowoff method, was varied. FIG. 8 shows the results of the test.

In general, the more residual toner t, the higher the image density will be. The density of the toner image transferred from photosensitive drum 32 to sheet p is 1.0 or thereabout, and the transfer efficiency ranges from about 75 to 90%. If the density of the transferred toner image, the concentration of the residual toner, and the transfer efficiency are Dp, Dd, and $\eta$, respectively, there is a relation $$Dp/(Dd+Dp)=\eta.$$

If transfer efficiency $\eta$ is set to the lower limit value 75% of the aforesaid range, and if this value is substituted into the above equation, we have $$1.6/(Dd+1.6)=0.75.$$

Therefore, concentration Dd (based on the mending-tape method) of untransferred toner t remaining on the surface of photosensitive drum 32 is about 0.53. If such an amount remains on the drum surface, a memory will be produced unless toner t is cleared away. If concentration Dcl of residual toner t on the drum surface can be lowered to 0.1, however, a memory on the transferred image will raise no problems at all.

If Dcl=0.1 and Dd=0.53 are given, cleaning efficiency $\xi$ is $$\begin{aligned}\xi &= 1 - Dcl/Dd \\ &= 1 - 0.1/0.53 \\ &\approx 0.81.\end{aligned}$$

Thus, if the cleaning efficiency is about 80% or more, a memory on the transferred image will raise no problems at all.

To obtain the cleaning efficiency of 80% or more, it is necessary only that the amount of toner charge range from 18 to 28 $\mu$c/g, as shown in FIG. 8.

Photosensitive drum 32 will now be described in detail.

Figure 9:
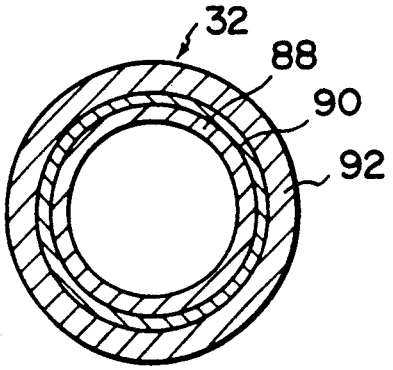
FIG. 9 is a sectional view of the photosensitive drum applied to the developing device shown in FIG. 3.

As shown in FIG. 9, photosensitive drum 32 includes hollow cylinder 88, charge generating layer 90 which holds charge generated by charger 34, and charge transport layer 92. Cylinder 88 is made of aluminum and has an outside diameter of 30 mm and a wall thickness of 0.8 mm. Layer 90 is provided on cylinder 88, while layer 92 is applied to the surface of layer 90.

Charge generating layer 90 is formed by applying p-type phthalocyanine (from Toyo Ink Mfg. Co., Ltd.) and butyral resin (from UCC Co., Ltd.) to a thickness of 0.1 mm at a ratio of 1:1 by weight. Charge transport layer 92 is formed by applying 9-ethylcarbazole-3-carboxyaldehyde-methylhydrazone (ECPM; from Inuyu Yakuhin Co., Ltd.) and polyarylate (U-100; from Unitika Ltd.) to a thickness of 17 $\mu$m at a ratio of 1:0.65 by weight.

Figure 10:
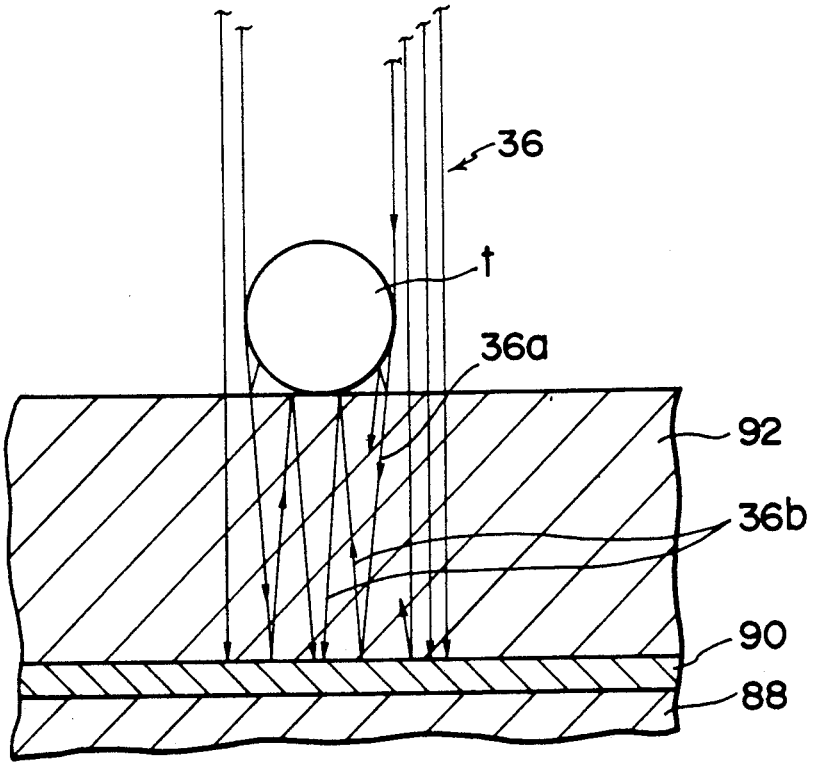
FIG. 10 is a diagram showing an exposure condition obtained when residual toner particles are on the surface of the drum shown in FIG. 9.

Charge transport layer 92 is a transparent layer covering charge generating layer 90. Thus, even though toner particles with a diameter of 30 $\mu$m or less exist on the surface of photosensitive drum 32 when the drum is exposed, layer 90 suffers hardly any shades of the toner particles or is subjected only to shades of practically negligible darkness, due to diffracted light 36*a* and reflected scattered light 36*b* inside layer 92, as shown in FIG. 10.

If toner particles with a diameter of more than 30 $\mu$m exist on the surface of photosensitive drum 32, however, the obtained image is rendered defective. More specifically, a memory, in the form of white spots with a diameter of 30 $\mu$m or less, is formed on a black solid image.

Figure 11:
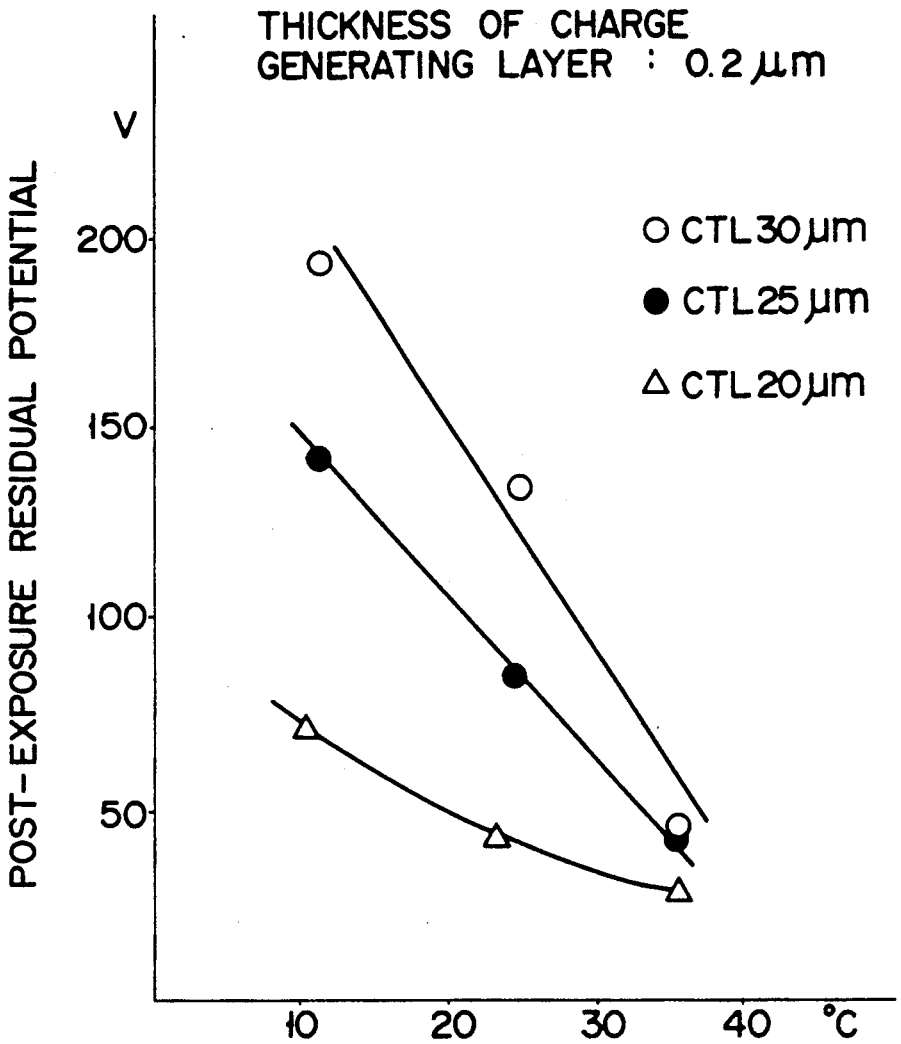
FIG. 11 is a diagram showing the relationships between the ambient conditions and the residual potential obtained when the thickness of the charge transport layer of the drum of FIG. 9 is varied.

Charge transport layer 92 may be of any suitable material which can transmit light, such as laser beam 36 emitted from optical system 40. Defective images will be produced unless the thickness of layer 92 is equal to or more than the mean particle diameter of toner t. In consideration of the residual potential characteristic, moreover, the thickness of layer 92 is preferably 30 $\mu$m or less, as shown in FIG. 11.

Figure 12:
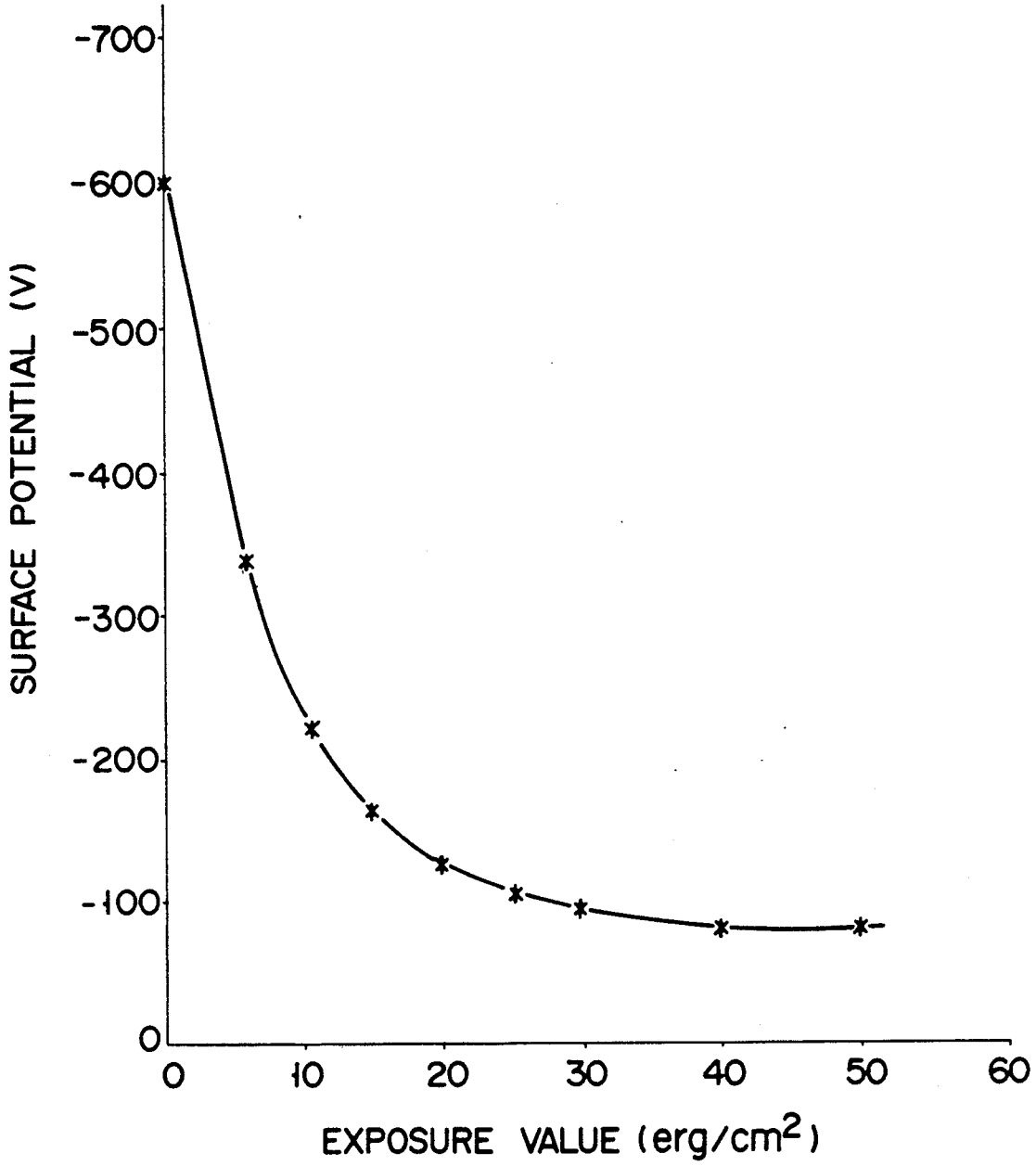
FIG. 12 is a diagram showing the photosensitivity of the drum of FIG. 9.

Photosensitive drum 32 used in the present embodiment has a sensitivity for half-potential light quantity of 6.2 erg/cm2. as shown in FIG. 12. The exposure value of optical system 4 ranges from 30 to 50 erg/cm2.

In developing the cleaning process, the relationship between the amount of residual toner and the memory was examined. It has been noticed that a memory is produced on the image if the amount of residual toner is 0.1 mg or more. This situation corresponds to a case such that the transfer efficiency and the transfer density are 75% and about 1.0, respectively. Thus, even when the voltage of the transfer charger was raised after the transfer efficiency had been lowered at high humidity, a memory image was produced at a humidity of 85%.

Figure 13:
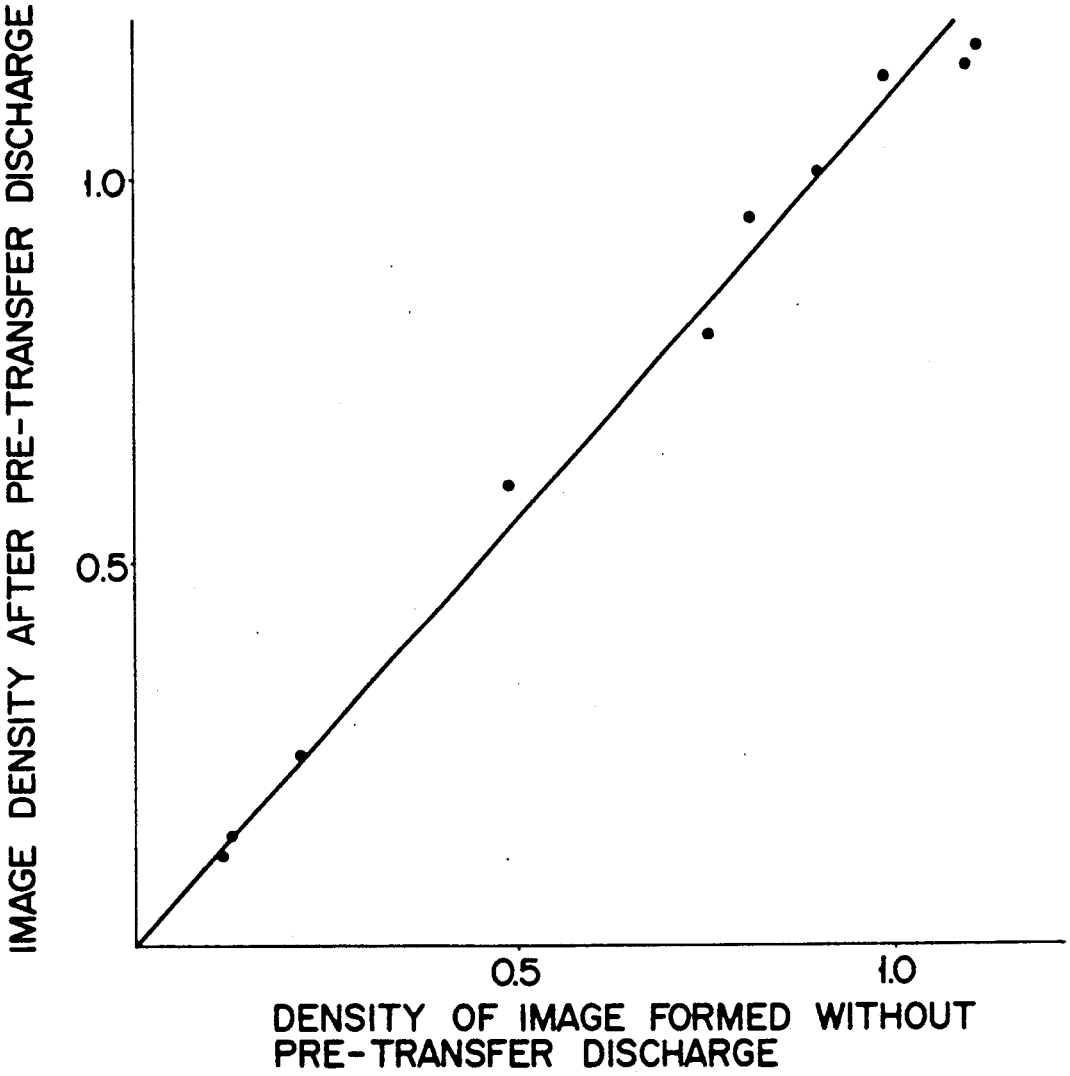
FIG. 13 is a diagram showing the relationships between the image density obtained after pre-transfer discharge in the apparatus of FIG. 2 and the image density obtained without the pre-transfer discharge.

When photosensitive drum 32 was de-electrified before transfer by means of pre-transfer discharge lamp 94, as shown in FIG. 13, the memory was removed. At this time, lamp 94 required a light quantity not less than twice the half-potential exposure value of drum 32.

To detect the cause of such a situation, the image density was examined for transferred images subjected and not subjected to pre-transfer discharge or de-electrification. Thereupon, the density of the former or discharged image proved to be about 10% higher than that of the latter or undischarged image. This is because the transfer efficiency at high humidity was increased so that it was substantially equal to the value obtained at normal temperature, whereby a memory was prevented from appearing.

In the apparatus of this embodiment, sheet P is transported above developing device 42. Therefore, pre-transfer discharge lamp 94 must be located above roller 62 and below sheet path 96.

If photosensitive drum 32, which is small-sized, is mounted right over developing device 42, scatter toner (color powder) t will possibly adhere to pre-transfer discharge lamp 94. Thus, as the number of recorded sheets increases, the quantity of light applied to drum 32 decreases. In the present embodiment, therefore, Mylar 100 is located at irradiation aperture 98 through which light emitted from discharge lamp 94 is applied to drum 32. A transparent conductor film (not shown) is provided on the drum-side surface of Mylar 100. A bias voltage of −600 V, which is equal to the charging potential of drum 32, is applied to the conductor film, whereby toner t is prevented from adhering to the film. If the bias voltage is of the same polarity as the charging potential of drum 32 and is not lower than the developing bias voltage, it serves to prevent the adhesion of toner t. If the bias voltage reaches 1,000 V or more, however, discharge will be easily caused between the conductor film and other components. Preferably, therefore, the bias voltage for the prevention of the toner adhesion is not lower than the developing bias voltage and below 1,000 V.

Pre-transfer discharge lamp 94 is situated farther from photosensitive drum 32 than developing roller 62 is. The light emitted from lamp 94 is guided to drum 32 by means of transparent plate 102 of acrylic resin.

Pre-transfer discharge cover 104 doubles as a guide for sheet p. In order to prevent defective transfer attributable to a leakage of the charge on sheet p, cover 104 is formed of an insulating member. Alternatively, however, cover 104 may be composed of a conductive member, such as a metallic member, and an insulating member on the surface thereof.

As described herein, residual toner t on the surface of photosensitive drum 32 is removed simultaneously with the developing process by electrical attraction by means of developing device 42. It is therefore unnecessary to use a recovery box for toner t. Thus, the apparatus can be reduced in size and weight, and cannot be internally soiled by the toner. Moreover, there is no need of a cleaning blade which should otherwise be used in contact with drum 32. Thus, the life performance of drum 32 is improved.

Furthermore, photosensitive drum 32 includes charge generating layer 90 and charge transport layer 92 covering the same. In this arrangement, even though residual toner t exists on drum 32 while the drum is being exposed, layer 92 cannot be shaded by the toner, thus ensuring production of a satisfactory image.

What is claimed is:

1. An image forming apparatus adapted to use a developing agent to form an image comprising:

an image carrier including a charge generating layer for holding a charge and a charge transport layer, covering said charge generating layer, of a type which passes charge therethrough;

charging means for electrically charging the image carrier so that electric charge is produced and held in the charge generating layer;

exposure means for applying a light beam bearing image information to the charge generating layer of the image carrier through the charge transport layer thereby forming an electrostatic latent image corresponding to the image information on a surface of the image carrier;

developing means for developing the electrostatic latent image by means of a developing agent, thereby forming a developed image on the surface of the image carrier; and transfer means for transferring the developed image to the surface of the image carrier, and said charge transport layer having a thickness which is equal to or more than a mean particle diameter of the developing agent, so that said light beam, applied by the exposure means, passes through the charge transport layer so as to impinge upon those regions of the charge generating layer which would be otherwise shaded by the residual developing agent.

2. The image forming apparatus according to claim 1, wherein said charge transport layer has a thickness of 30μm or less.

3. The image forming apparatus according to claim 1, wherein said developing agent is composed of color powder and magnetic powder, the mean particle diameter of said color powder being 30 μm or less.

4. The image forming apparatus according to claim 3, wherein the thickness of said charge transport layer is not less than the mean particle diameter of the color powder.

5. The image forming apparatus according to claim 1, wherein said image carrier is charged for the same polarity as the developing agent.

6. The image forming apparatus according to claim 1, wherein said image carrier has a base, said charge generating layer being formed on the base and covered by the charge transport layer.

7. An image forming apparatus as in claim 1 wherein said thickness of said charge transport layer is less than 30 micrometers.

8. An image forming apparatus comprising:

an image carrier including a charge generating layer and a charge transport layer;

charging means for electrically charging the image carrier so that electric charge is produced and held in the charge generating layer;

exposure means for applying a light beam bearing image information to the charge generating layer of the image carrier through the charge transport layer, thereby forming an electrostatic latent image corresponding to the image information on the surface of the image carrier;

developing means for developing the electrostatic latent image by means of a developing agent, said developing agent being composed of color powder and magnetic powder, said color powder having a mean particle diameter of no more than 30 μm, thereby forming a developed image on the surface of the image carrier; and transfer means for transferring the developed image to the surface of the image carrier, said developing means serving to remove, simultaneously with the development of the electrostatic latent image, the residual developing agent remaining on the surface of the image carrier, and said light beam, applied by the exposure means, passing through the charge transport layer to those regions of the charge generating layer shaded by the residual developing agent, said charge transport layer having a thickness of no more than 30 μm but which is not less than the mean particle diameter of said color powder.

9. An apparatus as in claim 8 wherein said charging means is a charger which forms a uniform surface potential on said image carrier.

10. An apparatus as in claim 8 wherein said image carrier is an organic photoconductor photosensitive drum.

11. A method for forming an image using developing agent particles, comprising the steps of:

providing a two layer photosensitive drum, with a charge generating layer for holding a charge and a charge transport layer, covering said charge generating layer, of a type which passes charge therethrough, and which has a thickness greater than or equal to a mean particle diameter of said developing agent such that said light beam, applied by the exposure means, passes through the charge transport layer so as to impinge upon those regions of the charge generating layer which would be otherwise shaded by any residual developing agent from a previous image forming operation;

after said previous image forming operation, but prior to a current image forming operation, charging a surface of a photosensitive drum including all residual developing agent particles thereon, to a predetermined voltage;

exposing said surface of said photosensitive drum to a light source such that said light source passes through the charge transport layer to impinge on those regions of the charge generating layer shaded by the residual developing agent, to attenuate a surface potential of said photosensitive drum;

developing an electrostatic latent image and simultaneously removing residual developing agent particles, by supplying developing agent to the latent image formed in the exposing step and simultaneously removing residual developing agent particles; and transferring the developing agent image to the surface of a sheet.

12. A method as in claim 11 comprising the further step of discharging the photosensitive drum.

13. A method as in claim 12 wherein said initial charging step charge the surface to a voltage of −600 volts.

14. A method as in claim 8, wherein said thickness of said charge transport layer is less than 30 micrometers.

* * * * *